US010221643B2

(12) United States Patent
Zhang et al.

(10) Patent No.: US 10,221,643 B2
(45) Date of Patent: Mar. 5, 2019

(54) DOWNHOLE TOOLS HAVING CONTROLLED DEGRADATION AND METHOD

(71) Applicants: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(72) Inventors: Zhihui Zhang, Katy, TX (US); Zhiyue Xu, Cypress, TX (US); Goang-Ding Shyu, Houston, TX (US); Juan Carlos Flores Perez, The Woodlands, TX (US); James Doane, Friendswood, TX (US); Yingqing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/599,142

(22) Filed: May 18, 2017

(65) Prior Publication Data

US 2018/0283121 A1 Oct. 4, 2018

Related U.S. Application Data

(63) Continuation-in-part of application No. 15/472,382, filed on Mar. 29, 2017.

(51) Int. Cl.
*E21B 29/02* (2006.01)
*E21B 47/06* (2012.01)
(Continued)

(52) U.S. Cl.
CPC ..... *E21B 29/02* (2013.01); *E21B 33/12* (2013.01); *E21B 34/06* (2013.01); *E21B 47/00* (2013.01);
(Continued)

(58) Field of Classification Search
CPC ..... E21B 29/00; E21B 29/02; E21B 34/16
See application file for complete search history.

(56) References Cited

U.S. PATENT DOCUMENTS 6,253,843 B1 7/2001 Rawson et al.
7,270,191 B2 9/2007 Drummond et al.
(Continued)

FOREIGN PATENT DOCUMENTS

WO 2013022635 A2 2/2013

OTHER PUBLICATIONS

"Spectre Disintegrating Frac Plug", Baker Hughes, 2015, 8 Pages.
(Continued)

*Primary Examiner* — Giovanna C. Wright
*Assistant Examiner* — Tara E Schimpf
(74) *Attorney, Agent, or Firm* — Cantor Colburn LLP

(57) ABSTRACT

A downhole assembly includes a downhole tool including a degradable-on-demand material, the degradable-on-demand material including a matrix material, and a unit in contact with the matrix material, the unit including a core comprising an energetic material configured to generate energy upon activation to facilitate degradation of the downhole tool and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor and to deliver a start signal to the electrical circuit in response to the sensed signals indicating an occurrence of the target event or parameter wherein, after the start signal is delivered from the control unit, the electrical circuit is closed and the igniter is initiated.

27 Claims, 11 Drawing Sheets

(51) Int. Cl.

| | |
|---|---|
| ***E21B 47/00*** | (2012.01) |
| ***E21B 33/12*** | (2006.01) |
| ***E21B 34/06*** | (2006.01) |
| *E21B 43/116* | (2006.01) |
| *E21B 47/18* | (2012.01) |
| *E21B 47/12* | (2012.01) |
| *E21B 34/00* | (2006.01) |

(52) U.S. Cl.
CPC ..... *E21B 47/06* (2013.01); *E21B 43/116* (2013.01); *E21B 47/122* (2013.01); *E21B 47/18* (2013.01); *E21B 2034/005* (2013.01)

(56) References Cited

U.S. PATENT DOCUMENTS

| | | | | |
|---|---|---|---|---|
| 8,056,638 | B2 | 11/2011 | Clayton et al. | |
| 8,235,102 | B1 | 8/2012 | Robertson | |
| 8,256,521 | B2 | 9/2012 | Swor et al. | |
| 8,272,446 | B2 | 9/2012 | Swor et al. | |
| 8,291,969 | B2 | 10/2012 | Swor et al. | |
| 8,291,970 | B2 | 10/2012 | Swor et al. | |
| 8,322,449 | B2 | 12/2012 | Clayton et al. | |
| 8,327,926 | B2 | 12/2012 | Robertson | |
| 8,403,037 | B2 | 3/2013 | Agrawal et al. | |
| 8,528,633 | B2 | 9/2013 | Agrawal et al. | |
| 9,022,107 | B2 | 5/2015 | Agrawal et al. | |
| 9,101,978 | B2 | 8/2015 | Xu et al. | |
| 9,267,347 | B2 | 2/2016 | Agrawal et al. | |
| 2007/0209802 | A1 | 9/2007 | Xu et al. | |
| 2013/0160992 | A1 | 6/2013 | Agrawal et al. | |
| 2014/0014339 | A1* | 1/2014 | O'Malley | E21B 43/261 166/281 |
| 2014/0190685 | A1* | 7/2014 | Frazier | E21B 33/1208 166/250.01 |
| 2014/0202712 | A1 | 7/2014 | Fripp et al. | |
| 2014/0251612 | A1 | 9/2014 | Powers | |
| 2014/0262327 | A1 | 9/2014 | Xu et al. | |
| 2014/0363692 | A1 | 12/2014 | Marya et al. | |
| 2015/0027723 | A1 | 1/2015 | Fripp et al. | |
| 2015/0190984 | A1* | 7/2015 | Zhang | B32B 15/01 428/646 |
| 2015/0239795 | A1* | 8/2015 | Doud | C06B 45/32 428/649 |
| 2015/0259263 | A1 | 9/2015 | Shrerman et al. | |
| 2015/0292288 | A1* | 10/2015 | Kasperski | E21B 27/02 166/285 |
| 2016/0130906 | A1 | 5/2016 | Garvey et al. | |
| 2016/0209391 | A1 | 7/2016 | Zhang et al. | |
| 2016/0333668 | A1 | 11/2016 | Xu et al. | |
| 2017/0009563 | A1* | 1/2017 | Holder | E21B 43/263 |
| 2018/0171736 | A1 | 6/2018 | Xu et al. | |
| 2018/0171737 | A1 | 6/2018 | Xu et al. | |
| 2018/0171738 | A1 | 6/2018 | Xu et al. | |
| 2018/0171757 | A1 | 6/2018 | Xu | |

OTHER PUBLICATIONS

Huang et al. "Construction and Properties of Structure- and Size-controlled Micro/nano-Energetic Materials", Defence Technology 9 (2013) 59-79.

International Search Report for International Application No. PCT/US20171062291, dated Feb. 20, 2018, 7 pages.

Written Opinion of the International Search Report for International Application No. PCT/US2017/062291, dated Feb. 20, 2018, 11 pages.

* cited by examiner

DOWNHOLE TOOLS HAVING CONTROLLED DEGRADATION AND METHOD

CROSS REFERENCE TO RELATED APPLICATIONS

The present application is a continuation-in-part of U.S. patent application Ser. No. 15/472,382, filed Mar. 29, 2017, which is hereby incorporated by reference in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating downhole tools have been developed. Instead of milling or drilling operations, these tools can be removed by dissolution of engineering materials using various wellbore fluids. One challenge for the self-disintegrating downhole tools is that the disintegration process can start as soon as the conditions in the well allow the corrosion reaction of the engineering material to start. Thus the disintegration period is not controllable as it is desired by the users but rather ruled by the well conditions and product properties. For certain applications, the uncertainty associated with the disintegration period can cause difficulties in well operations and planning. An uncontrolled disintegration can also delay well productions. Therefore, the development of downhole tools that can be disintegrated on-demand is very desirable.

BRIEF DESCRIPTION

A downhole assembly including a downhole tool including a degradable-on-demand material, the degradable-on-demand material including: a matrix material; and, a unit in contact with the matrix material, the unit including: a core comprising an energetic material configured to generate energy upon activation to facilitate degradation of the downhole tool; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter; wherein, after the start signal is delivered from the control unit, the electrical circuit is closed and the igniter is initiated.

A method of controllably removing a downhole tool of a downhole assembly, the method including disposing the downhole assembly including the downhole tool in a downhole environment, the downhole tool including a degradable-on-demand material including a matrix material; and a unit in contact with the matrix material, the unit including a core comprising an energetic material configured to generate energy upon activation to facilitate degradation of the downhole tool; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter; sensing a downhole event or parameter with the sensor, the sensor sending sensed signals to the control unit; comparing the sensed signals to a target value, and when the threshold value is reached, sending the start signal to the electrical circuit; closing the electrical circuit after the start signal is sent; initiating the igniter when the electrical circuit is closed; activating the energetic material within the core using the igniter; and degrading the downhole tool.

BRIEF DESCRIPTION OF THE DRAWINGS

The following descriptions should not be considered limiting in any way. With reference to the accompanying drawings, like elements are numbered alike:

FIG. 8A illustrates the triggering system in an inactive state and FIG. 8B illustrates the triggering system in an active state;

DETAILED DESCRIPTION

Figure 1:
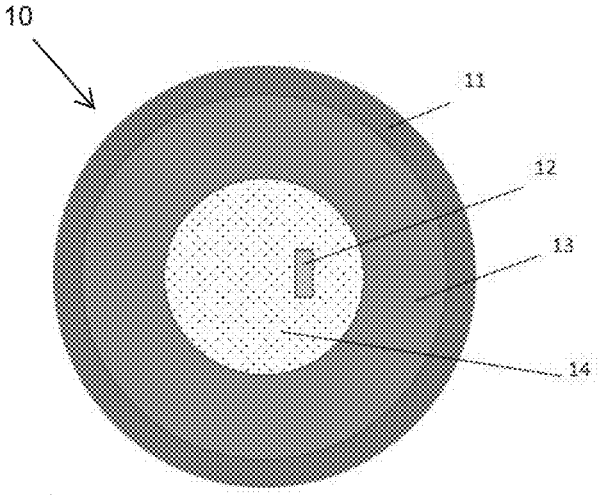
FIG. 1 is a cross-sectional view of an exemplary multilayered unit according to an embodiment of the disclosure.

The disclosure provides a multilayered unit that can be embedded in a downhole article, attached to a downhole article, or disposed between two adjacent components of a downhole assembly. The downhole article or downhole assembly containing the multilayered unit has controlled degradation, including partial or full disintegration, in a downhole environment. The controlled degradation, and more particularly the controlled disintegration, is implemented through integrating a high-strength matrix material with energetic material that can be triggered on demand for rapid tool disintegration.

The multilayered unit includes a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer.

The multilayered unit can have various shapes and dimensions. In an embodiment, the multilayered unit has at least one stress concentration location to promote disintegration. As used herein, a stress concentration location refers to a location in an object where stress is concentrated. Examples of stress concentration locations include but are not limited to sharp corners, notches, or grooves. The multilayered unit can have a spherical shape or an angular shape such as a triangle, rhombus, pentagon, hexagon, or the like. The multilayered unit can also be a rod or sheet. The matrix around the multilayered unit can also have stress concentration locations.

The energetic material comprises a thermite, a thermate, a solid propellant fuel, or a combination comprising at least one of the foregoing. The thermite materials include a metal powder (a reducing agent) and a metal oxide (an oxidizing agent), where choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide and combinations including at least one of the foregoing, for example.

Thermate materials comprise a metal powder and a salt oxidizer including nitrate, chromate and perchlorate. For example thermite materials include a combination of barium chromate and zirconium powder; a combination of potassium perchlorate and metal iron powder; a combination of titanium hydride and potassium perchlorate, a combination of zirconium hydride and potassium perchlorate, a combination of boron, titanium powder, and barium chromate, or a combination of barium chromate, potassium perchlorate, and tungsten powder.

Solid propellant fuels may be generated from the thermate compositions by adding a binder that meanwhile serves as a secondary fuel. The thermate compositions for solid propellants include, but not limited to, perchlorate and nitrate, such as ammonium perchlorate, ammonium nitrate, and potassium nitrate. The binder material is added to form a thickened liquid and then cast into various shapes. The binder materials include polybutadiene acrylonitrile (PBAN), hydroxyl-terminated polybutadiene (HTPB), or polyurethane. An exemplary solid propellant fuel includes ammonium perchlorate ($NH_4ClO_4$) grains (20 to 200 μm) embedded in a rubber matrix that contains 69-70% finely ground ammonium perchlorate (an oxidizer), combined with 16-20% fine aluminum powder (a fuel), held together in a base of 11-14% polybutadiene acrylonitrile or hydroxyl-terminated polybutadiene (polybutadiene rubber matrix). Another example of the solid propellant fuels includes zinc metal and sulfur powder.

As used herein, the activator is a device that is effective to generate spark, electrical current, or a combination thereof to active the energetic material. The activator can be triggered by a preset timer, characteristic acoustic waves generated by perforations from following stages, a pressure signal from fracking fluid, or an electrochemical signal interacting with the wellbore fluid. Embodiments of methods to activate an energetic material are further described below.

The multilayered unit has a support layer to hold the energetic materials together. The support layer can also provide structural integrity to the multilayered unit.

The multilayered unit has a protective layer so that the multilayered unit does not disintegrate prematurely during the material fabrication process. In an embodiment, the protective layer has a lower corrosion rate than the support layer when tested under the same testing conditions. The support layer and the protective layer each independently include a polymeric material, a metallic material, or a combination comprising at least one of the foregoing. The polymeric material and the metallic material can corrode once exposed to a downhole fluid, which can be water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the support layer comprises the metallic material, and the protective layer comprises the polymeric material. In another embodiment, the support layer comprises the polymeric material, and the protective layer comprises the metallic material. In yet another embodiment, both the support layer and the protective layer comprise a polymeric material. In still another embodiment, both the support layer and the protective layer comprise a metallic material.

Exemplary polymeric materials include a polyethylene glycol, a polypropylene glycol, a polyglycolic acid, a polycaprolactone, a polydioxanone, a polyhydroxyalkanoate, a polyhydroxybutyrate, a copolymer thereof, or a combination comprising at least one of the foregoing.

The metallic material can be a corrodible metallic material, which includes a metal, a metal composite, or a combination comprising at least one of the foregoing. As used herein, a metal includes metal alloys.

Exemplary corrodible metallic materials include zinc metal, magnesium metal, aluminum metal, manganese metal, an alloy thereof, or a combination comprising at least one of the foregoing. In addition to zinc, magnesium, aluminum, manganese, or alloys thereof, the corrodible material can further comprise a cathodic agent such as Ni, W, Mo, Cu, Fe, Cr, Co, an alloy thereof, or a combination comprising at least one of the foregoing to adjust the corrosion rate of the corrodible material. The corrodible material (anode) and the cathodic agent are constructed on the microstructural level to form μm-scale galvanic cells (micro-galvanic cells) when the material are exposed to an electrolytic fluid such as downhole brines. The cathodic agent has a standard reduction potential higher than −0.6 V. The net cell potential between the corrodible material and cathodic agent is above 0.5 V, specifically above 1.0 V.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

As used herein, a metal composite refers to a composite having a substantially-continuous, cellular nanomatrix comprising a nanomatrix material; a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles. The matrix comprises deformed powder particles formed by compacting powder particles comprising a particle core and at least one coating layer, the coating layers joined by solid-state bonding to form the substantially-continuous, cellular nanomatrix and leave the particle cores as the dispersed particles. The dispersed particles have an average particle size of about 5 μm to about 300 μm. The nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials. The chemical composition of the nanomatrix material is different than the chemical composition of the particle core material.

The corrodible metallic material can be formed from coated particles such as powders of Zn, Mg, Al, Mn, an alloy thereof, or a combination comprising at least one of the foregoing. The powder generally has a particle size of from about 50 to about 150 micrometers, and more specifically about 5 to about 300 micrometers, or about 60 to about 140 micrometers. The powder can be coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W, Cu, Fe, Si, Ca, Co, Ta, or Re. Such coated magnesium powders are referred to herein as controlled electrolytic materials (CEM). The CEM materials are then molded or compressed forming the matrix by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

In an embodiment, the metallic material comprises Al, Mg, Zn. Mn, Fe, an alloy thereof, or a combination comprising at least one of the foregoing. In specific embodiments, the metallic material comprises aluminum alloy, magnesium alloy, zinc alloy, iron alloy, or a combination comprising at least one of the foregoing. In the instance wherein both the support layer and the protective layer comprise a metallic material, the metallic materials in the support layer and the protective layer are selected such that the support layer and the protective layer are easier to disintegrate when the energetic material is activated as compared to an otherwise identical unit except for containing only one metallic layer.

The core is present in an amount of about 5 to about 80 vol %, specifically about 15 to about 70 vol %; the support layer is present in an amount of about 20 to about 95 vol %, specifically about 30 to about 85; and the protective layer is present in an amount of about 0.1 to about 20 vol %, specifically about 1 to about 10 vol %, each based on the total volume of the multilayered unit.

FIG. 1 is a cross-sectional view of an exemplary multilayered unit according to an embodiment of the disclosure. As shown in FIG. 1, unit 10 has a core 14, an activator 13 disposed in the core, a support layer 12 disposed on the core, and a protective layer 11 disposed on the support layer. Thus, in this embodiment, the unit 10 is a multi-layered unit.

The multilayered units can be embedded into different tools. The location and number of multilayered units are selected to ensure that the whole tool can disintegrate into multiple pieces when the energetic material is activated. Thus in an embodiment, the disclosure provides a degradable article, and in particular a disintegrable article, comprising a matrix and a multilayered unit embedded therein. The matrix of the article can be formed from a corrodible metallic material as described herein. The matrix can further comprise additives such as carbides, nitrides, oxides, precipitates, dispersoids, glasses, carbons, or the like in order to control the mechanical strength and density of the articles if needed. In an embodiment, the matrix has pre-cracks including but not limited to pre-crack notches or pre-crack grooves around the multilayered unit to facilitate the quick degradation, and in particular the quick disintegration, of the article once the energetic material is activated.

Figure 2:
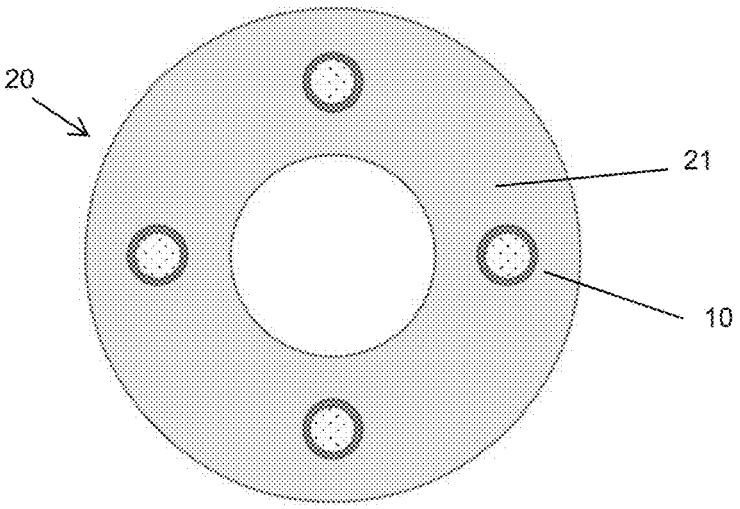
FIG. 2 is a cross-sectional view of an exemplary downhole article embedded with multilayered units.
Figure 3:
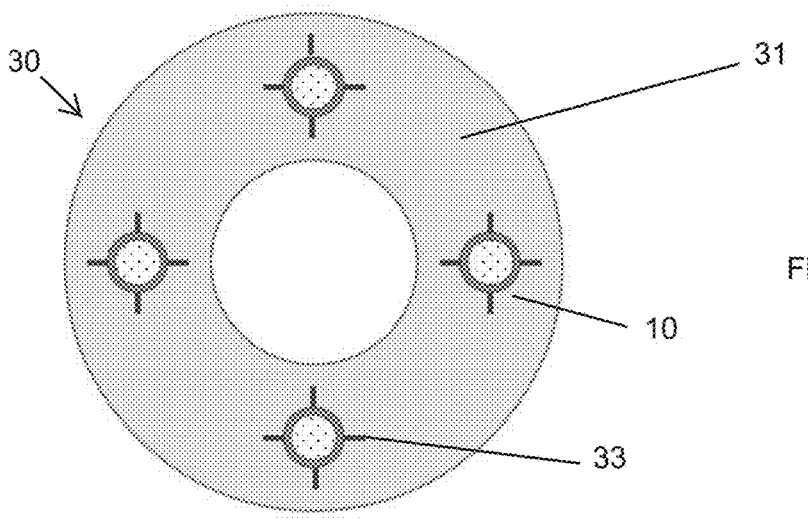
FIG. 3 is a cross-sectional view of another exemplary downhole article embedded with multilayered units, wherein the downhole article has pre-cracks around the multilayered units.
Figure 4:
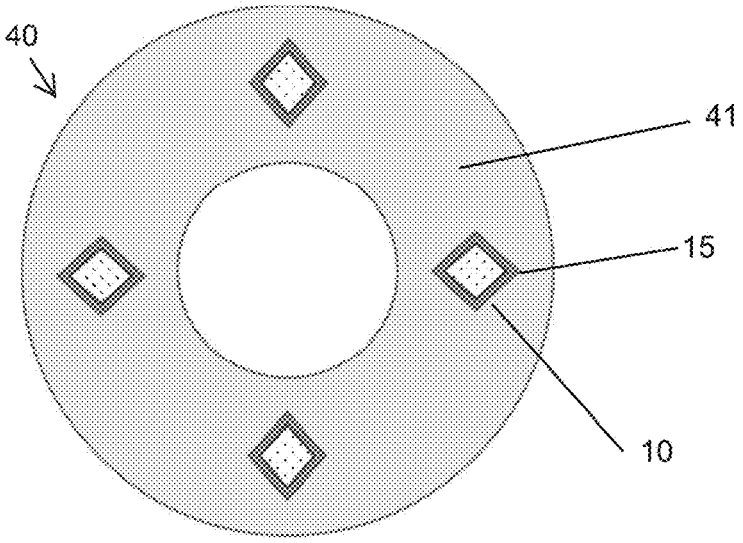
FIG. 4 is a cross-sectional view of yet another exemplary downhole article embedded with multilayered units, wherein the multilayered units and the matrix of the downhole article surrounding the multilayered units have stress concentration locations.
Figure 5:
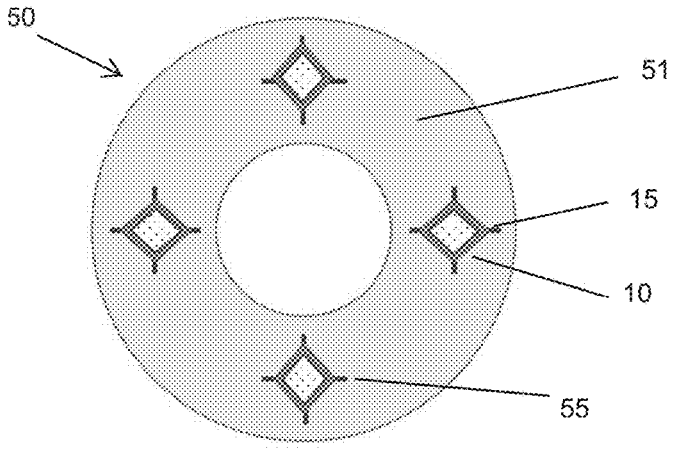
FIG. 5 is a cross-sectional view of still another exemplary downhole article embedded with multilayered units, wherein the multilayered units have stress concentration locations; and the downhole article matrix surrounding the multilayered unit has stress concentration locations as well as pre-cracks.

FIGS. 2-4 are cross-sectional views of various exemplary downhole articles embedded with multilayered units. In downhole article 20, multiple multilayered units 10 as described herein are embedded in matrix 21. In downhole article 30, multilayered units 10 are disposed in matrix 31, wherein matrix 31 has pre-cracks 33. In downhole article 40, multilayered units 10 are embedded in matrix 41, where the multilayered units have stress concentration locations 15. In downhole article 50, the multilayered units have stress concentration locations 15 and the matrix 51 has pre-cracks 55. In any of the above embodiments or combination of embodiments, the degradable-on-demand material includes the multi-layered units and the matrix to which the multilayered units are in contact.

Degradable articles, and in particular disintegrable articles, are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, or a bridge plug.

A downhole assembly comprising a downhole article having a multilayered unit embedded therein is also provided. More than one component of the downhole article can be an article having embedded multilayered units.

The multilayered units can also be disposed on a surface of an article. In an embodiment, a downhole assembly comprises a first component and a multilayered unit disposed on a surface of the first component. The downhole assembly further comprises a second component, and the multilayer unit is disposed between the first and second components. The first component, the second component, or both can comprise corrodible metallic material as disclosed herein. Exemplary downhole assemblies include frac plugs, bridge plugs, and the like.

Figure 6:
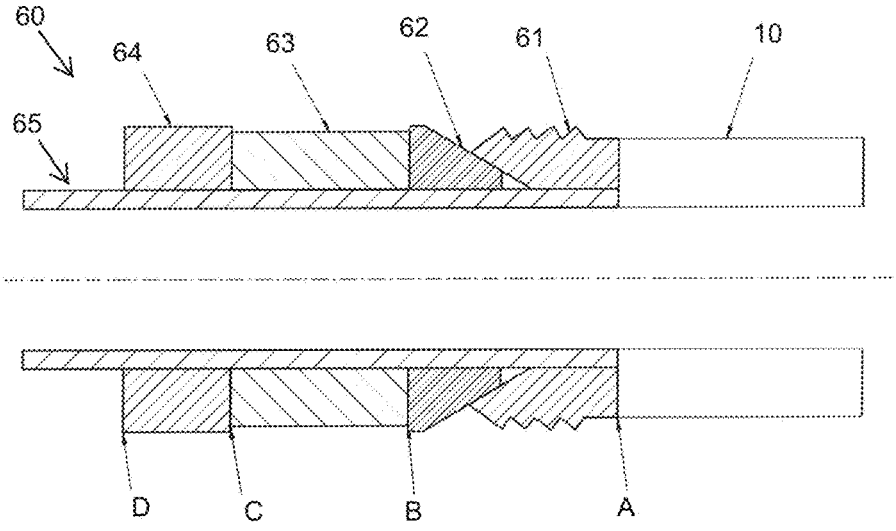
FIG. 6 illustrates a downhole assembly having a multilayered unit attached to a component of the assembly or disposed between adjacent components of the assembly.

FIG. 6 schematically illustrates a downhole assembly having a multilayered unit 10 attached to a component of the assembly or disposed between adjacent components of the assembly. As shown in FIG. 6, one embodiment of a downhole assembly 60 includes elements including an annular body 65 having a flow passage therethrough; a frustoconical element 62 disposed about the annular body 65; a sealing element 63 carried on the annular body 65 and configured to engage a portion of the frustoconical element 62; and a slip segment 61 and an abutment element 64 disposed about the annular body 65. While illustrated as individual elements, one or more of the elements of the downhole assembly 60 may be integrally combined, such as, but not limited to, annular body 65 and frustoconical element 62. Further, other embodiments of the downhole assembly 60 may include additional elements as required for particular operations. One or more of the frustoconical element 62, sealing element 63, abutment element 64, and slip segment 61 can have one or more embedded units 10, such as multi-layered units 10, as disclosed herein. That is, the unit 10 can be integrally combined with any one or more of the elements of the downhole assembly 60. Alternatively or in addition, the unit 10 can be disposed on a surface of the slip segment 61 (position A), disposed on a surface of abutment element 64 (position D), between frustoconical element 62 and sealing element 63 (position B) or between sealing member 63 and abutment element 64 (position C).

Figure 7:
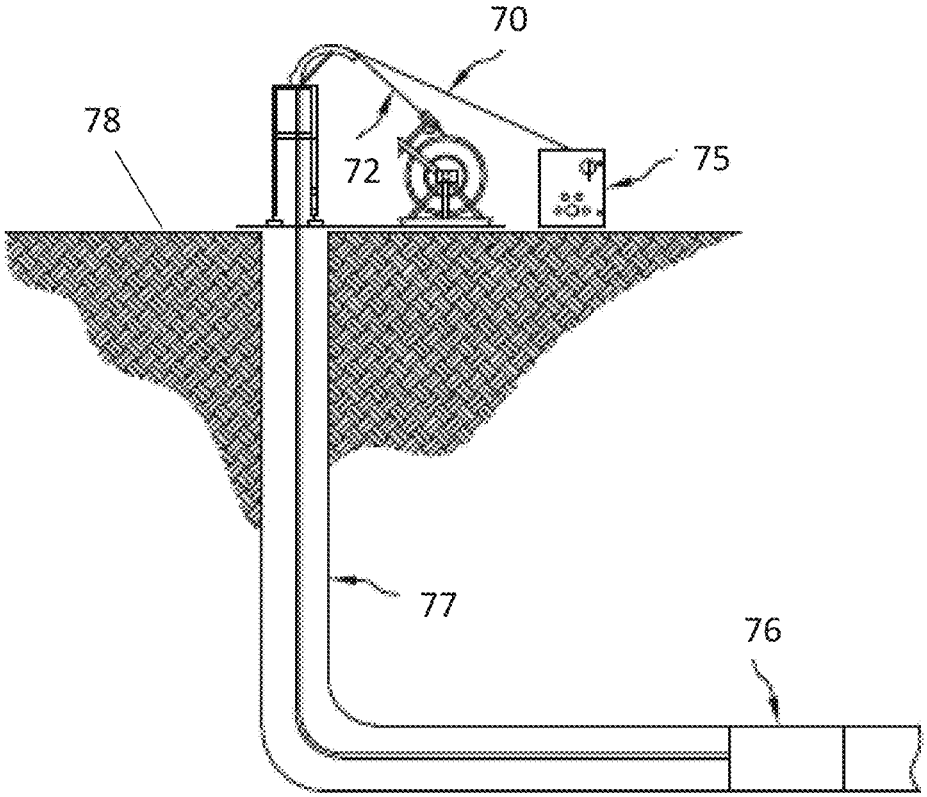
FIG. 7 is a schematic diagram illustrating a downhole assembly disposed in a downhole environment according to an embodiment of the disclosure.

Referring to FIG. 7, in one embodiment, a downhole assembly 76 is disposed in borehole 77 via a coil tubing or wireline 72. A communication line 70 couples the downhole assembly 76 to a processor 75. The communication line 70 can provide a command signal such as a selected form of energy from processor 75 to the downhole assembly 76 to activate the energetic material in the downhole assembly 76, such as by initiating activation of the activator 13 in at least one multi-layered unit 10 included in the downhole assembly 76. The communication line 70 can be optical fibers, electric cables or the like, and it can be placed inside of the coil tubing or wireline 72.

A method of controllably removing a downhole article or a downhole assembly comprises disposing a downhole article or a downhole assembly as described herein in a downhole environment; performing a downhole operation; activating the energetic material; and degrading, including full or partially disintegrating, the downhole article. A downhole operation can be any operation that is performed during drilling, stimulation, completion, production, or remediation. A fracturing operation is specifically mentioned. To start an on-demand degradation process, one multilayered unit is triggered and other units will continue the rapid degradation process following a series of sequenced reactions. The sequenced reactions might be triggered by pre-set timers in different units. Alternatively, the energetic material in one unit is activated and reacts to generate heat, strain, vibration, an acoustic signal or the like, which can be sensed by an adjacent unit and activate the energetic material in the adjacent unit. The energetic material in the adjacent unit reacts and generates a signal that leads to the activation of the energetic material in an additional unit. The process repeats and sequenced reactions occur.

Disintegrating the downhole article comprises breaking the downhole article into a plurality of discrete pieces. Advantageously, the discrete pieces can further corrode in the downhole fluid and eventually completely dissolve in the downhole fluid or become smaller pieces which can be carried back to the surface by wellbore fluids.

Figure 8A:
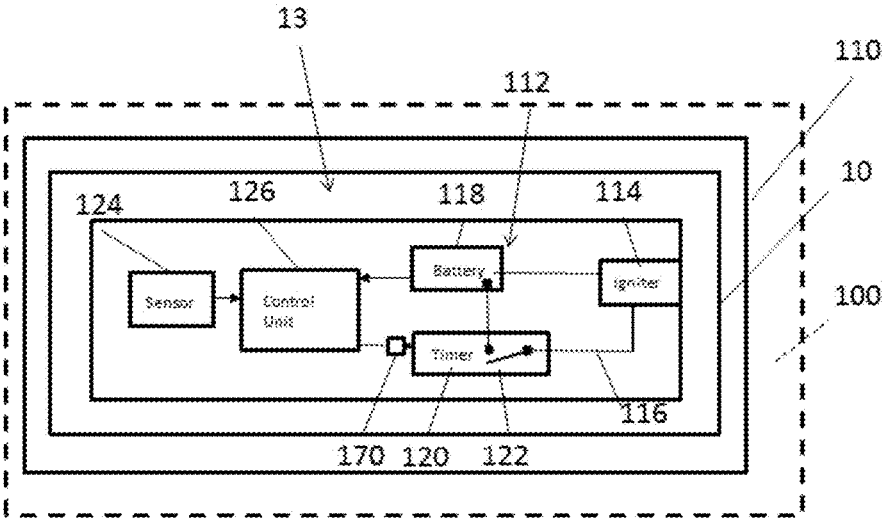
FIGS. 8A and 8B schematically illustrate an embodiment of an activator for a unit of a downhole tool, the activator having a triggering system, where
Figure 8B:
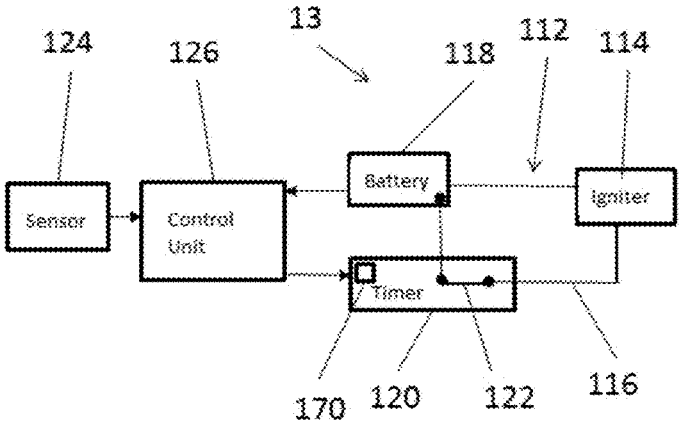

FIGS. 8A-8B illustrate an embodiment of an activator 13 for the unit 10, such as, but not limited to, the multi-layered unit. The activator 13 includes a triggering system 112. The triggering system 112 provides for operator-selected initiation of the ignition of the degradable downhole article having the degradable-on-demand material having the matrix material and the energetic material as described in the previous embodiments or combination of previous embodiments. In one embodiment, the triggering system 112 is provided within the core 14 of the unit 10. To provide easier operator access to the triggering system 112, the triggering system 112 may be disposed in the core 14 after the core 14 is formed. For example, the core 14 of energetic material may be formed with a receiving area and the triggering system 112 may be inserted into the receiving area in the core 14. Alternatively, the unit 10 may be formed in sections, with the triggering system 112 insertable within a receiving area in the core 14 and the sections subsequently mated to trap the triggering system 112 therein. In a further embodiment, at least a portion of the triggering system 112 is accessible from an exterior of the unit 10, such as sensor 124, if the type of sensor 124 employed in the triggering system 112 would exhibit improved sensing abilities from such an arrangement. The degradable downhole article may be a portion of a downhole tool 110 or may be an entire downhole tool 110, and a downhole assembly 100 may be further provided that incorporates the downhole tool 110. The degradable-on-demand material does not begin degradation until a time of a detected event or parameter, or pre-selected time period after the detected event or parameter, that is chosen by an operator (as opposed to a material that begins degradation due to conditions within the borehole 77), thus the degradation is controllable, and may further be exceedingly more time efficient than waiting for the material to degrade from borehole conditions. In this embodiment the time period after the detected event or parameter is chosen by an operator by setting a timer 120 and providing the appropriate programming in a control unit 126 (which can be done by the manufacturer or operator), as will be further described below. The energetic material as previously described is located in the core 14 which also contains the activator 13. The degradable-on-demand material may further include the above-noted matrix material (21, 31, 41, 51) in which one or more of the unit 10 is contained or otherwise in contact. In the following embodiments, the units 10 may include either a single layer covering the core 14 or multiple layers 11, 12 as previously described. The activator 13 is contained in at least one of the one or more units 10, and the units 10 are in contact with the matrix of the downhole tool 110. The downhole tool 110 with the multi-layered units 10 incorporated within the degradable-on-demand material is thus a self-contained package that can be run downhole, such that in one embodiment the downhole tool 110 need not be connected to surface, and the downhole tool 110 can serve a downhole function prior to degradation, including full or partial disintegration.

In one embodiment, the triggering system 112 includes an igniter 114 arranged to directly ignite the energetic material in the core 14. The igniter 114 may also directly ignite another material that then ignites the core 14. In either case, the core 14 is ignited. In the illustrated embodiment, the triggering system 112 further includes an electrical circuit 116. In FIG. 8A, the circuit 116 is open so that the igniter 114 is not activated, not provided with electric current, and thus does not ignite the energetic material. In FIG. 8B, the circuit 116 is closed so that battery 118 starts to provide electric current to activate and set off the igniter 114, which ignites the energetic material in the core 14 and thus initiates the degradation of the remainder of the degradable-on-demand material within the downhole tool 110. In some embodiments, closure of the circuit 116 is enacted by the timer 120. While the battery 118 could be separately connected to the timer 120 for operation of the timer 120, the timer 120 preferably includes its own separate battery 170 so that the battery 118 is dedicated to the igniter 114 to ensure sufficient energy release at the time of ignition. The timer 120 can be pre-set at surface 78 (see FIG. 7) or can be pre-set any time prior to running the downhole assembly 100 having the downhole tool 110 within the borehole 77. Having the timer 120 within the self-contained package of the downhole tool 110 and unit 10 enables independence of physical connections to surface 78 with respect to control of the triggering system 112. The time period may also be altered by the control unit 126 depending on the sensed data sensed by sensor 124. For the purposes of these embodiments, the sensor 124 may include one or more different types of sensors for sensing one or more different parameters or events that together would be indicative of an occurrence of a predetermined parameter or event. The sensor 124 may thus include one or more sensors configured to sense, for example, pressure, temperature, velocity, frequency, density, chemicals, electrochemicals, and/or electromagnetic tags. Depending on the event or parameter, the predetermined time period could be as low as zero seconds, such that the circuit 116 would close substantially immediately after detection of the predetermined event or parameter, or could be any time period greater than zero seconds including, but not limited, to several hours. The predetermined time period would depend on the downhole tool 110 and the predetermined event or parameter.

While the timer 120 can be set to close the switch 122 after any pre-selected time period, in one embodiment, the timer 120 remains inactive and does not start the time period until the predetermined event or parameter occurs within the borehole 77 and is sensed by the sensor 124. Once the timer 120 is initiated, such as by the control unit 126 which will send a start signal to the timer 120 to begin the timer 120, the time period commences. The time period may be set such that the switch 122 closes after the expected completion of a procedure in which the downhole tool 110 is utilized. In the embodiment where the timer 120 is inactive until the target event or parameter occurs, the timer 120 is programmed to have a time period to close switch 122 from about the time the sensed condition reaches the threshold value to the time the downhole tool 110 has completed a downhole procedure. Once the downhole tool 110 is no longer required, the circuit 116 can be closed in order to permit the battery 118 to provide electric current to set off the igniter 114. As demonstrated by FIG. 8B, once the circuit 116 is in the closed condition, and igniter 114 is activated, heat is generated, and the degradable article within the downhole tool 110 breaks into small pieces, such as an energetic material and a matrix material. The degradation of the downhole tool 110 is controlled, as opposed to a rupture or detonation that may uncontrollably direct pieces of the degraded downhole tool 110 forcefully into other remaining downhole structures.

In an embodiment where it is known that degradation of the downhole tool 110 is desired immediately after the sensed signal reaches the threshold value or the target event or parameter is otherwise sensed, then the time period in the timer 120 to close switch 122 can be set to zero. In some embodiments where immediate degradation is desired, the timer 120 is not included in the triggering system 112, and upon detection of the threshold value of the sensed signal by the control unit 126 or other sensed signal that indicates the occurrence of the target event or parameter, the control unit 126 may send the start signal to the electrical circuit 116 to start the initiation of the igniter 114, such as by closing the switch 122 to place the electrical circuit 116 in the closed condition.

Figure 9:
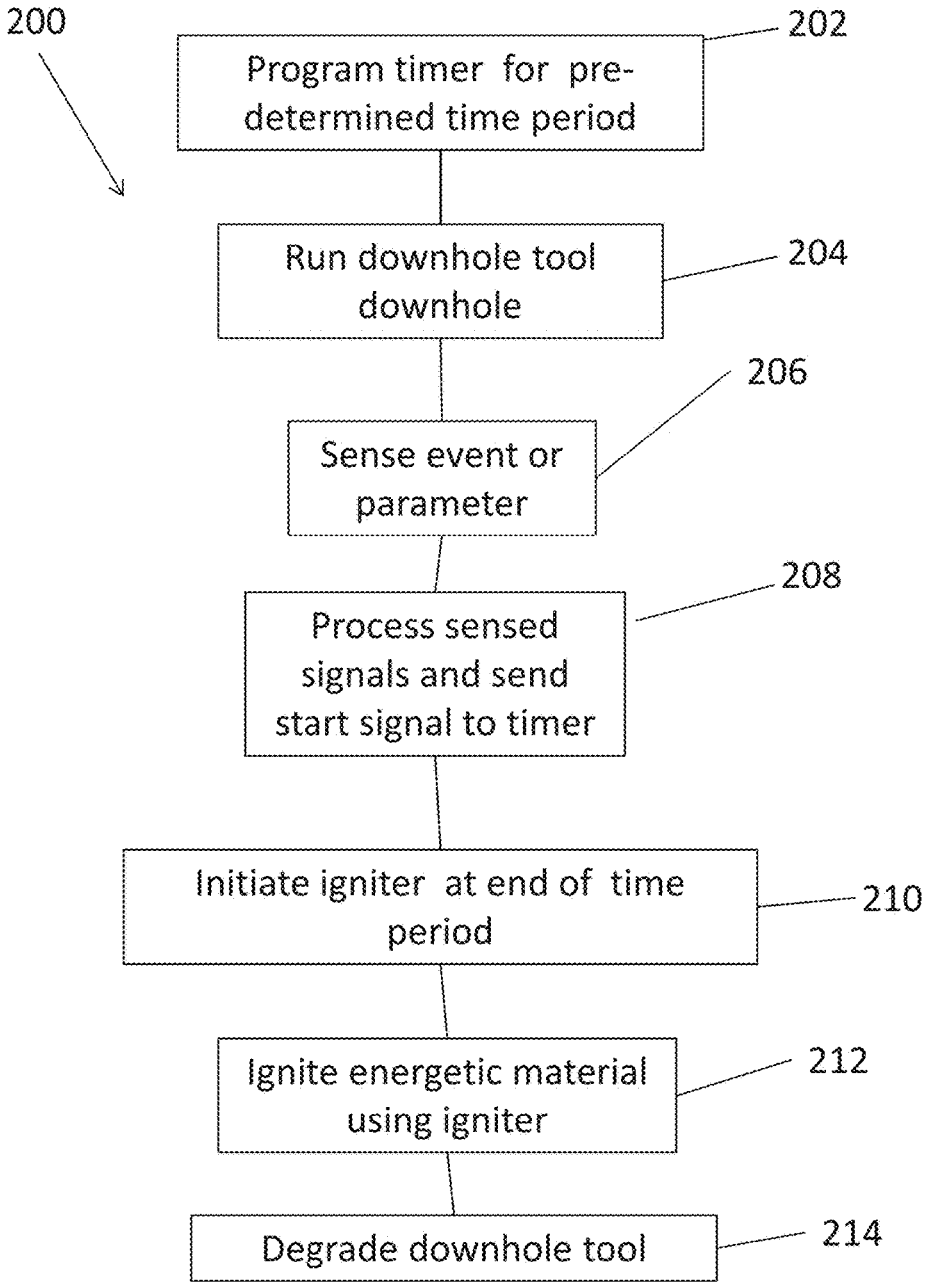
FIG. 9 is a flowchart of an embodiment of a method of degrading a downhole tool.

FIG. 9 is a flowchart of an embodiment of a method 200 of employing the triggering system 112 to degrade the downhole tool 110 of the downhole assembly 100. As indicated by box 202, the timer 120 is set by an operator or by a manufacturer, however the timer 120 remains inactive (the timer is not yet started) at this stage. As indicated by box 204, the downhole tool 110 is run downhole within borehole 77. The downhole tool 110 may be attached to any other equipment, tubing string, and other downhole tools that form the entirety of the downhole assembly 100. As indicated by box 206, a target event or parameter occurs within the borehole 77 that is sensed by sensor 124. The event or parameter could include, but is not limited to, a shock wave from perforation gun firing; a mud pulse; vibration caused by fluids being pumped through the downhole assembly 100; a pressure differential across the downhole tool 110 such as hydraulic fracturing pressure acting across a frac plug; electromagnetic wave sent from a bottom hole assembly to treat a next zone, sent from surface or from on-going operations in a neighboring well; a chemical or electrochemical signal, and/or an electromagnetic tag. The target event or parameter may also include a combination of events and/or parameters, such that the control unit 126 would not send a start signal to the timer 120 (or alternatively would not send a start signal to the electrical circuit 116 when the timer 120 is not included in the triggering system 112) until all of the threshold events/and or parameters have been detected. As indicated by box 208, the control unit 126 receives the sensed signal(s) from the sensor 124 and processes the signals to verify validity for starting the timer 120. That is, the signals are processed to determine whether or not they meet the requirements for starting the timer 120. The requirements for starting the timer 120 can be programmed into the control unit 126, and the control unit 126 will process the sensed signals and compare them with threshold (target) values to determine whether or not to send the start signal to the timer 120. In some embodiments, the control unit 126, or alternatively another controller within the triggering system 112, may further change the predetermined time period in response to the sensed signals. Once the start signal is sent to timer 120, the timer 120 will run for the predetermined time period. If the time period is zero, the circuit 116 will close substantially immediately, and if the time period is greater than zero then the circuit 116 will remain open until the end of the time period. In either case, when the circuit 116 is closed, the igniter 114 will be initiated, as indicated by box 210. As indicated by box 212, once the igniter 114 is active, the energetic material is ignited and activated, which, as indicated by box 214, leads to degradation of the downhole tool 110.

Figure 10:
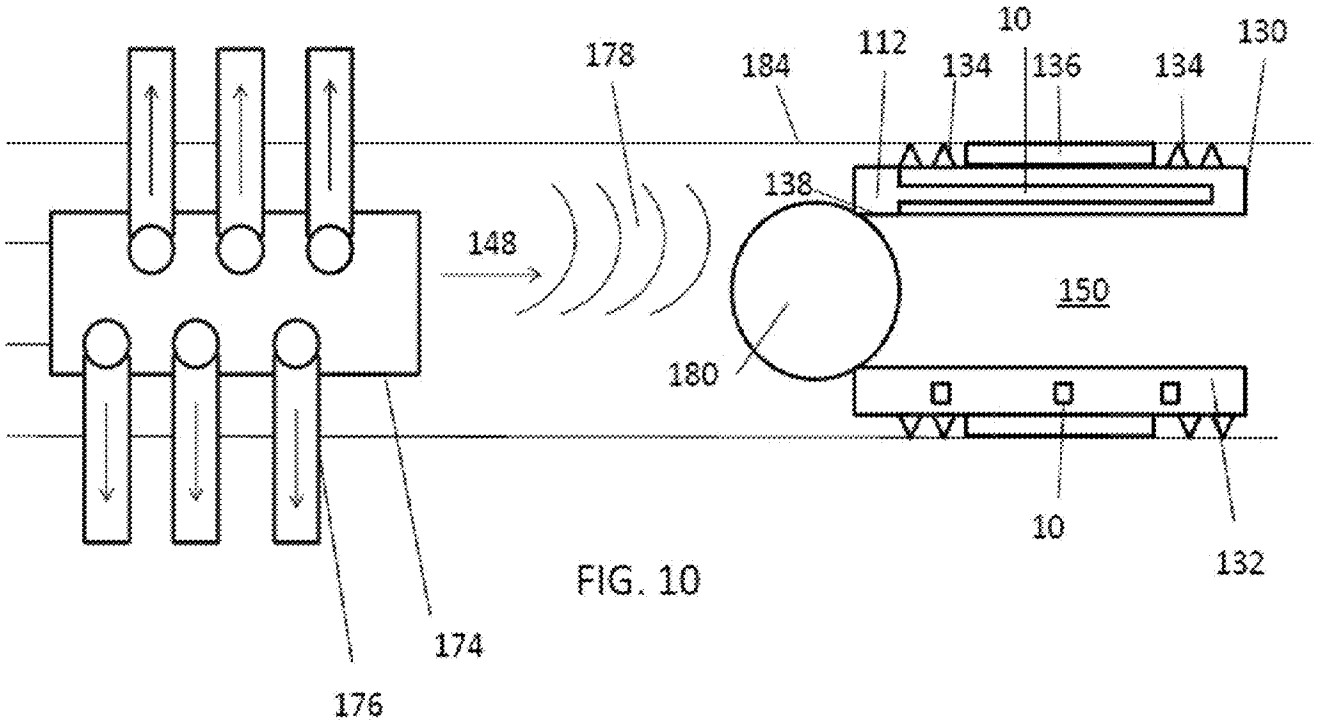
FIG. 10 schematically illustrates an embodiment of a method of degrading a downhole tool including sensing a shock wave.

FIG. 10 illustrates one embodiment of a method of degrading a downhole tool 110. In this embodiment, the downhole tool 110 is a frac plug 130. The frac plug 130 includes a body 132, slips 134, and a resilient member 136. The triggering system 112 of the unit 10, such as but not limited to a multi-layered unit, is illustrated as disposed at an uphole end of the frac plug 130, to position the sensor 124 closer to an uphole area of the downhole tool 110. The unit 10 may be attached to or embedded within the frac plug 130, which includes the matrix material. In one embodiment, a plurality of units 10 is included in the frac plug 130. The 10 may include different sizes depending on their location within the frac plug 130. One or more of the units 10 may extend longitudinally along a length of the body 132, such that when the igniter 114 in the triggering system 112 is ignited, the energetic material in the core 14 can be quickly activated across a span of the frac plug 130. In one embodiment, the unit 10 may additionally include a helical shape such that the energetic material is activated across a large portion of the frac plug 130 in both circumferential and longitudinal directions. At surface 78, the slips 134 and resilient member 136 have a first outer diameter which enables the frac plug 130 to be passed through the borehole 77. When the frac plug 130 reaches a desired location within the borehole 77, the frac plug 130 is set, such as by using a setting tool (not shown), to move the slips 134 radially outwardly to engage with an inner surface of a casing 184 lining the borehole 77 to prevent longitudinal movement of the frac plug 130 with respect to the borehole 77. At the same time, the resilient member 136 sealingly engages with the inner surface of the casing 184. The timer 120 (FIGS. 7A-7B) in the triggering system 112 is inactive when the frac plug 130 is run downhole. To prevent flow through flowbore 150 in a downhole direction 148, so as to enable the application of a pressure increase uphole of the frac plug 130, a frac ball 180 is landed on the frac plug 130. In particular, the frac ball 180 lands on seat 138. To perforate the casing 184 to access the formation, a perforating gun 174 is fired uphole of the frac plug 130 to create casing perforations 176. The pressure pulse 178 in the fluid generated by firing of the perforating guns 174 is detected by the sensor 124, which can include the sensor in the degradable-on-demand material, within the triggering system 112. The control unit 126 processes the sensed signal from the sensor 124, and once confirmed to be within the threshold range of a pressure pulse 178 from the perforating guns 174, the sensor 124 sends the start signal to the timer 120 to start the timer 120. Once the time period set in the timer 120 has elapsed, the igniter 114 will ignite the energetic material in the frac plug 130 to intentionally begin its degradation. Alternatively, the timer 120 may be removed such that the control unit 126 will close the switch 122 to close the electrical circuit 116 directly. In such an embodiment, the start signal sent by the control unit 126 will serve to close the electrical circuit 116, thus activating the igniter 114 instead of starting the timer 120.

In one embodiment, only select portions of the frac plug 130 are formed of the above-described degradable-on-demand material, such as, but not limited to the body 132. In another embodiment, other portions of the frac plug 130 are not formed of the degradable-on-demand material, however, such other portions may be formed of a different degradable material, such as the matrix material without the unit having energetic material, that can be effectively and easily removed once the disintegrable article made of the degradable-on-demand material of the frac plug 130 has been degraded, including partial or full disintegration, during the degradation of the disintegrable article within the frac plug 130. When only one part of the frac plug 130 is made of degradable-on-demand material, such as, but not limited to the body 132 or cone (such as frustoconical element 62 shown in FIG. 6), the degradation of that part will eliminate the support to the other components such as, but not limited to, the slip 134. In this way, the frac plug 130 can collapse off from the casing 184 to remove obstacle to flow path on-demand; in addition, degradable-on-demand material generates heat which can speed up the degradation of the rest of the frac plug 130.

Figure 11:
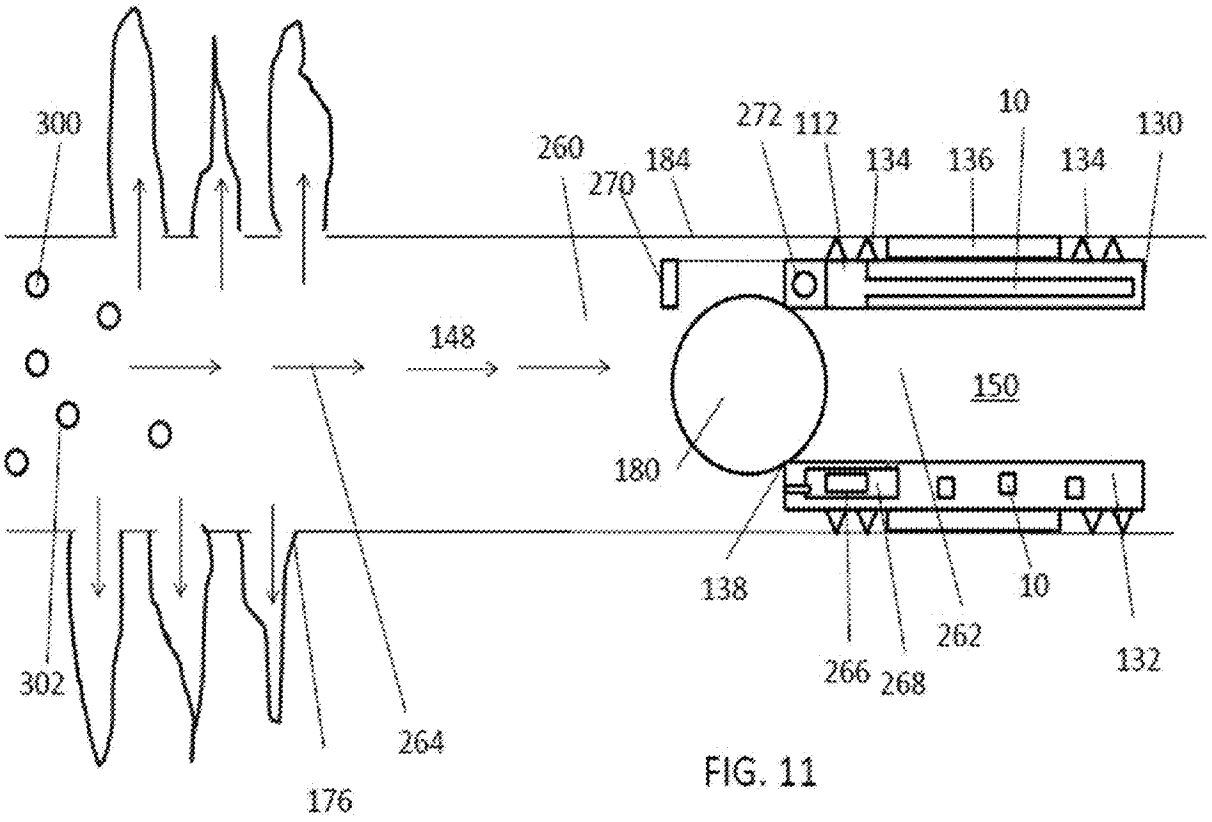
FIG. 11 schematically illustrates an embodiment of a method of degrading a downhole tool including sensing a pressure differential, vibrations, chemical or electrochemical signal, and/or electromagnetic tag.

FIG. 11 illustrates alternative or additional embodiments in which the method 200 of degrading a downhole tool 110 can be utilized. In one embodiment, the frac plug 130 is set within the casing 184 (or alternatively the borehole 77 if not lined with casing 184) and a pressure differential is detected by the sensor 124 within the triggering system 112 across the frac ball 180. In particular, a pressure in an uphole area 260 uphole of the frac plug 130 is compared with respect to a pressure in a downhole area 262 (separated from uphole area 260 when frac ball 180 lands on the frac plug 130) of the frac plug 130. In one embodiment, the sensor 124 may include a piston 266 arranged and sealed within a piston chamber 268 in the frac plug 130 where an uphole end of the piston chamber 268 is in fluid communication with the uphole area 260, and a downhole end of the piston chamber 268 is in fluid communication with the downhole area 262, such as by using access ports as shown. For clarity, the piston 266 is schematically depicted on a diametrically opposite side of the frac plug 130 from the triggering system 112, however the piston 266 may be positioned adjacent to or otherwise in communication with the triggering system 112. Before the frac ball 180 lands, the piston 266 may be balanced within the chamber 268. However, after the frac ball 180 lands, a particular amount of increased pressure in the uphole area 260 will shift the piston 266 in the downhole direction 148 within the piston chamber 268. When fracturing fluids 264 are utilized in a fracturing operation, the pressure in the uphole area 260 will be significantly greater than a pressure in the downhole area 262. At a particular sensed pressure differential, such as at a pressure differential which is indicative of a beginning of a fracturing operation, the piston 266 will shift within the chamber 268 in the downhole direction 148 and the position shift will be detected using the sensor 124 and the control unit 126 will send the start signal to the timer 120. The time period set in the timer 120 may be approximately the expected duration of a fracturing operation. Alternatively, the timer 120 may be removed such that the control unit 126 will close the switch 122 to close the electrical circuit 116 directly. In such an embodiment, the start signal sent by the control unit 126 will serve to close the circuit 116, thus activating the igniter 114 instead of starting the timer 120.

In another embodiment, also schematically depicted in FIG. 11, vibration is used to trigger the degradation of the downhole tool 110, such as, but not limited to, the frac plug 130. The sensor 124 in the triggering system 112 is employed to detect vibration of a vibratory element 270, 272. The vibratory element 270, 272 can include any element that will vibrate at a known frequency with a given flow rate in the flowbore 150. In one embodiment, the vibratory element 270 includes a reed. The reed 270 is positioned in the uphole area 260 and may extend substantially perpendicular to the direction of flow so that the reed 270 will vibrate in response to fluid flow. In another embodiment, the vibratory element 272 includes a ball, which may be caged and in fluid communication with the uphole area 260. Flow, such as from frac fluids 264 which may include proppant, will interact with the vibratory element 270, 272, causing it to vibrate. The frequency of the vibrations of the vibratory element 270, 272 will be compared in the control unit 126 to the threshold frequency at the known flow rate of the frac fluids 264. Once the control unit 126 determines that the fracturing operation has commenced, the start signal is sent to the timer 120 to begin the time period. The time period set in the timer 120 may be approximately the expected duration of a fracturing operation. Alternatively, the timer 120 may be removed such that the control unit 126 will close the switch 122 to close the electrical circuit 116 directly. In such an embodiment, the start signal sent by the control unit 126 will serve to close the circuit 116, thus activating the igniter 114 instead of starting the timer 120.

Figure 12:
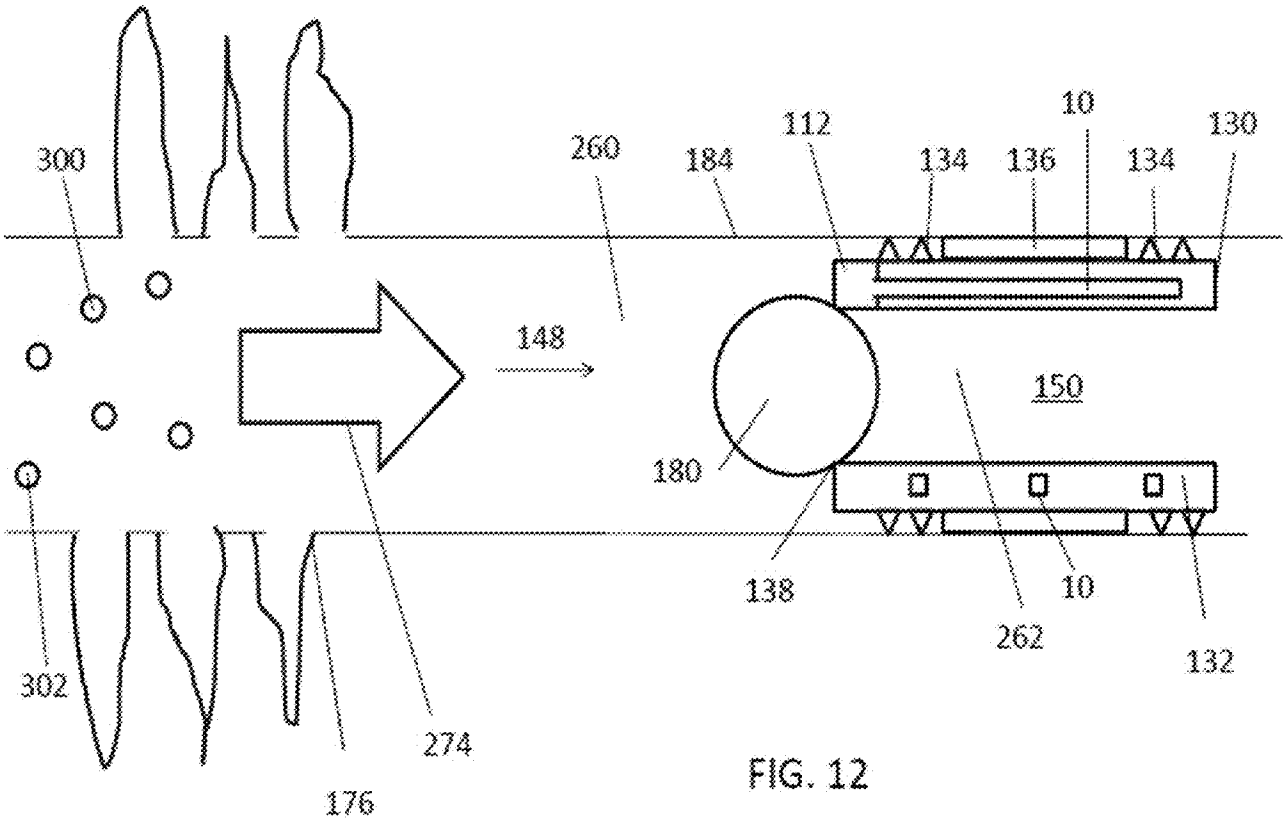
FIG. 12 schematically illustrates an embodiment of a method of degrading a downhole tool including sensing a mud pulse, chemical or electrochemical signal, and/or electromagnetic tag.

FIG. 12 schematically illustrates another embodiment of the method 200. In this embodiment, the frac plug 130 has already been set, the ball 180 dropped, and the frac operation has already been completed. At this point, the frac plug 130 has served its purpose and can be removed. A mud pulse 274, which can include any pressure wave generated in the uphole area 260 of the flowbore 150, is sent to the frac plug 130. The sensor 124, which can include the sensor in the degradable-on-demand material of the frac plug 130, will detect the mud pulse and send a sensed signal to the control unit 126. The control unit 126 will compare the sensed signal to a threshold value. In one embodiment, once the sensed signal is determined to reach the threshold value, the control unit 126 will send a start signal to the timer 120, and the timer 120 will begin the time period before closing the circuit 116. Since the frac plug 130 is no longer required, and can be removed immediately, the time period may be set to zero such that the switch 122 closes the electrical circuit 116 to set off the igniter 114 substantially immediately. Alternatively, the timer 120 may be removed such that the control unit 126 will close the switch 122 to close the electrical circuit 116 directly. In such an embodiment, the start signal sent by the control unit 126 will serve to close the circuit 116, thus activating the igniter 114 instead of starting the timer 120.

Figure 13:
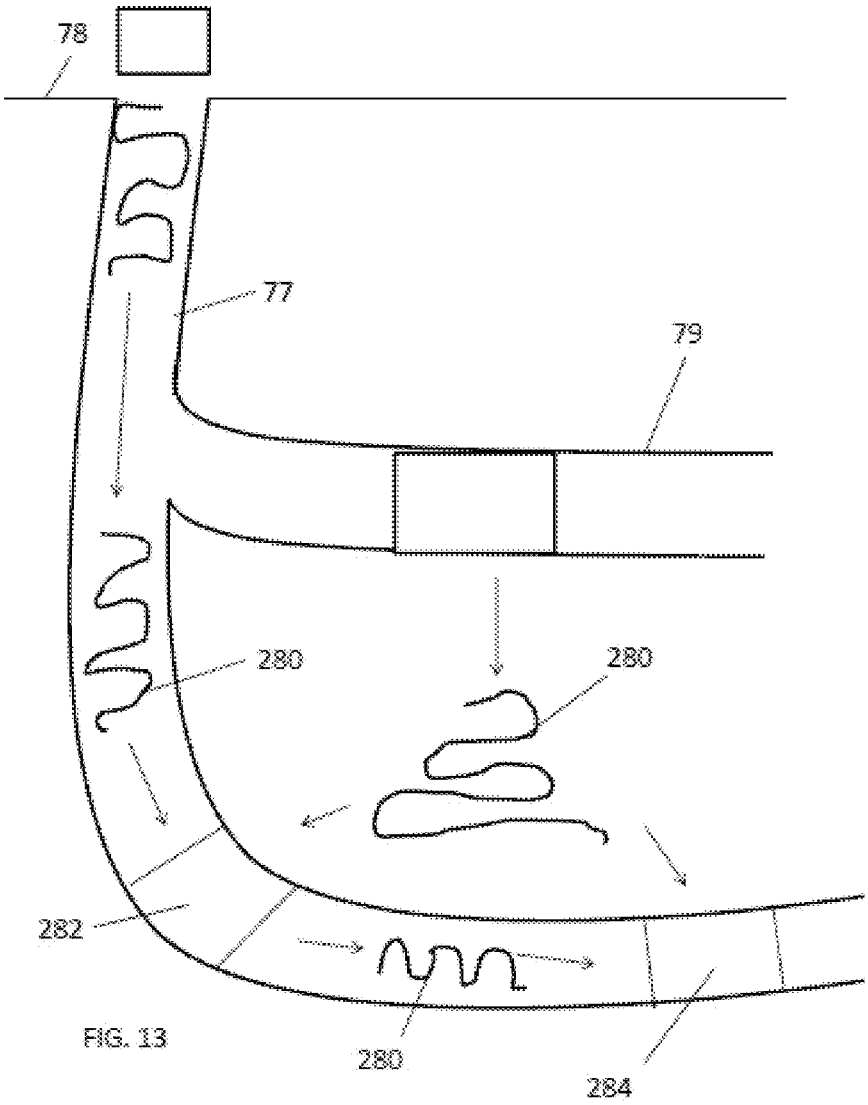
FIG. 13 schematically illustrates an embodiment of a method of degrading a downhole tool including detecting an electromagnetic wave; and, FIGS. 14A and 14B schematically illustrate an embodiment of a downhole assembly having a flapper valve having a flapper formed at least substantially of degradable-on-demand material, where

Referring now to FIG. 13, other methods of degrading a downhole tool 110 are schematically shown. In each embodiment shown in FIG. 13, the sensor 124 in the triggering system 112 is configured to sense an electromagnetic wave 280. In particular, the sensor 124 includes a detector or receiver, such as one having an antenna, which will detect the presence of a particular frequency or range of frequencies of electromagnetic wave 280. In one embodiment, the electromagnetic wave 280 generated from surface 78 is detected by the downhole tool 282 (which includes any of the features of the downhole tool 110), the sensed signal is processed by the control unit 126 in the downhole tool 282, and the timer 120 is started. As previously noted, the timer 120 may be set to zero if immediate degradation of the downhole tool 282 is desired upon detection of the electromagnetic wave 280, or the electrical circuit 116 may be closed by the start signal from the control unit 126 when the timer 120 is not included. In another embodiment, the electromagnetic wave 280 is generated from a bottom hole assembly (in this case downhole tool 282) to treat a next zone, such as where downhole tool 284 (which includes any of the features of the downhole tool 110) is located. In yet another embodiment, the electromagnetic wave 280 may be propagated from on-going operations in a neighboring borehole 79. While the borehole 79 is illustrated as a lateral bore in a multilateral completion, the neighboring borehole 79 may alternatively be a well not connected to the borehole 77.

In any of the above-described embodiments, the timer 120 may be set at surface 78 or an alternative location with an initial preset value, but then the triggering time (the time when the circuit 116 is closed) may be delayed or changed by sending a time-changing signal that is detected by the sensor 124, such as, but not limited to, the mud pulse 274, which is processed by the control unit 126 to change the time period for ignitor initiation. In an alternative embodiment, the timer 120 may be started at surface 78, but then the time period is altered while the downhole tool 110 is downhole by sending the time-changing signal that is detected by the sensor 124, such as, but not limited to, the mud pulse 274.

In one embodiment, only select portions of the frac plug 130 are formed of the above-described degradable-on-demand material, such as, but not limited to the body 132. In another embodiment, other portions of the frac plug 130 are not formed of the degradable-on-demand material, however, such other portions may be formed of a different degradable material that can be effectively and easily removed once the degradable article made of the degradable-on-demand material of the frac plug 130 has been degraded or during the degradation of the degradable article within the frac plug 130. When only one part of the frac plug 130 is made of degradable-on-demand material, such as, but not limited to the body 132 or cone (such as frustoconical element 62 shown in FIG. 6), the degradation of that part may eliminate the support to the other components, such as, but not limited to, the slip 134. In this way, the frac plug 130 can collapse off from the casing 184 to remove obstacle to flow path on-demand; in addition, degradable-on-demand material generates heat which can speed up the degradations of the rest of the frac plug 130.

Figure 14A:
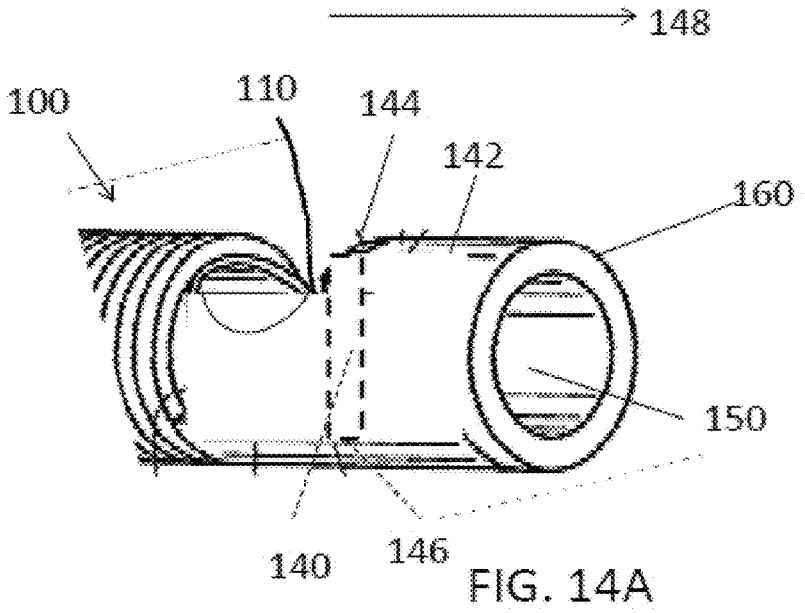
FIG. 14A illustrates the flapper in a closed condition.
Figure 14B:
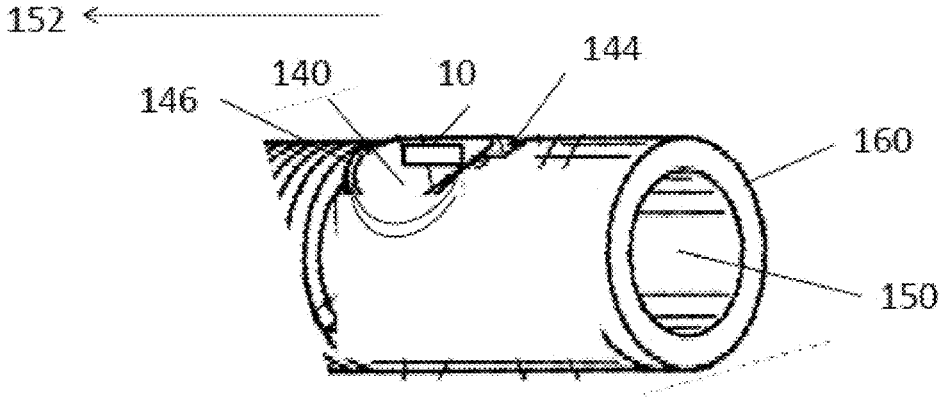
FIG. 14B illustrates the flapper in an open condition.

FIGS. 14A and 14B depict embodiments of the downhole assembly 100 where the downhole tool 110 is a fluid loss control valve 160 having a flapper 140. Flapper 140 is a plate-like member that is pivotally affixed at hinge 144 to one side of tubing string 142 and may be rotated 90 degrees between a closed position (FIG. 14A) where fluid flow is blocked through flowbore 150 in at least the downhole direction 148, and an open position (FIG. 14B) where fluid flow is permitted through flowbore 150. A spring member may be used to bias the flapper 140 toward its closed position, and may be opened using hydraulic fluid pressure. When the flapper 140 is incorporated into a fluid loss control valve 160 and wellbore isolation valve, the flapper 140 may be installed so that the flapper 140 must open by being pivoted upwardly (toward the opening of the well). As illustrated, a free end 146 of the flapper 140 is pivotally movable in a downhole direction 148 to close the flowbore 150 and the free end 146 is pivotally movable in an uphole direction 152 to open the flowbore 150. Conventionally, permanent removal of a fluid loss control valve flapper may be accomplished by breaking the flapper into fragments using mechanical force or hydraulic pressure, however an additional intervention trip would be required and broken pieces remaining in the well could pose potential problems. Thus, the flapper 140 includes the degradable-on-demand material. The degradable-on-demand material can be triggered or actuated remotely on a customer command (such as by, but not limited to, using communication line 70 shown in FIG. 7) to at least substantially degrade gradually (as opposed to a sudden rupture), and more particularly substantially fully disintegrate. The triggering signal may be electric current, or alternatively pressure pulse, high energy beam, as well as any of the other above-described embodiments. The degradable-on-demand material used to build the flapper 140 is a composite including the matrix (such as the previously described matrix 21, 31, 41, 51) and the energetic material (such as any of the above-described energetic material found in 10). The flapper 140 further includes a trigger, such as igniter 114 (see FIG. 8A) found in activator 13 of the unit 10 which is provided within the matrix of the flapper 140, such as in a pocket in the flapper 140. In another embodiment, the unit 10 may be attached to the flapper 140 as opposed to embedded therein. The igniter 114 is arranged to directly engage with the energetic material of the core 14 of the 10. The matrix provides the structural strength for pressure and temperature rating of the flapper 140. The energetic material once triggered provides the energy to degrade, including fully or partially disintegrate, the flapper 140. The activator 13 functions as a receiver for receiving an on-command (or pre-set) signal and to degrade the unit 10 and thus degrade the flapper 140. Signal can be sent remotely, such as from the surface 78 of the well, and at a selected time by the customer. The flapper 140 can alternatively include the triggering system 112 (FIG. 8A) within the activator 13 of the unit 10, where the timer 120 to trigger the degradation of the flapper 140 is started when the sensor 124 senses an event or parameter within the borehole, or, in embodiments not including the timer 120, the control unit 126 sends the start signal (in response to a sensed signal reaching a threshold value or otherwise in response to a sensed signal that indicates the occurrence of a predetermined event or parameter) to the electrical circuit 116 to close the electrical circuit 116 and activate the igniter 114. Also, while the flapper 140 has been described for use in a fluid loss control valve 160, the flapper 140 having the degradable-on-demand material may be utilized by other downhole assemblies.

The sensor 124 in any of the above-described embodiments may alternatively or additionally be configured to sense a chemical or electrochemical signal, or electromagnetic tag. As shown in FIGS. 11 and 12, a chemical or electrochemical element 300 or electromagnetic tag 302 may, in one embodiment, be delivered to the downhole tool 110 with frac fluid 264, proppant, or completion fluid, or by alternate fluids and delivery methods for the purpose of being detected by the sensor 124 in triggering system 112. The chemical or electrochemical element 300 or electromagnetic tag 302 could be delivered from surface 78 through the flowbore 150, or delivered by a chemical injection assembly (not shown). The control unit 126 will receive the sensed signals from the sensor 124, and upon the occurrence of the target event or parameter, such as an indication of the presence of the chemical or electrochemical element 300 or electromagnetic tag 302, the control unit 126 will send the start signal to the electrical circuit 116, to either close the electrical circuit 116 or to start the timer 120.

Further, while frac plugs and flappers have been particularly described, any of the above-described disintegrable articles and downhole tools may also take advantage of the methods of degrading downhole tools described herein.

Thus, embodiments have been described herein where the triggering system 112 is controlled in response to a signal indicative of a target event or parameter. The target event or parameter can occur downhole, such as in the employment of a perforation gun, the sensing of a pressure differential downhole, or signals from an adjacent downhole tool. The target event or parameter can also include a signal that is sent from surface, such as in a mud pulse or chemical, electrochemical, or electromagnetic tag that is carried with fluid from surface, which can thus incorporate wireless methods for creating the target event or parameter.

Various embodiments of the disclosure include a downhole article including: a matrix; and a multilayered unit disposed in the matrix, the multilayered unit including: a core comprising an energetic material and an activator; a support layer disposed on the core; and a protective layer disposed on the support layer, wherein the support layer and the protective layer each independently comprises a polymeric material, a metallic material, or a combination comprising at least one of the foregoing, provided that the support layer is compositionally different from the protective layer. In any prior embodiment or combination of embodiments, the multilayered unit has at least one stress concentration location. In any prior embodiment or combination of embodiments, the matrix has a pre-crack around the multilayered unit. In any prior embodiment or combination of embodiments, the activator is a device that is effective to generate spark, electrical current, or a combination thereof to active the energetic material. In any prior embodiment or combination of embodiments, the energetic material includes a thermite, a thermate, a solid propellant fuel, or a combination including at least one of the foregoing. In any prior embodiment or combination of embodiments, the metallic material includes Zn, Mg, Al, Mn, iron, an alloy thereof, or a combination comprising at least one of the foregoing. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing. In any prior embodiment or combination of embodiments, the support layer includes the metallic material; and the protective layer includes the polymeric material. In any prior embodiment or combination of embodiments, the support layer includes the polymeric material; and the protective layer includes the metallic material. In any prior embodiment or combination of embodiments, the core is present in an amount of 5 to 80 vol %, the support layer is present in an amount of 20 to 95 vol %, and the protective layer is present in an amount of 0.1 to 20 vol %, each based on the total volume of the multilayered unit. In any prior embodiment or combination of embodiments, a downhole assembly includes the downhole article.

Various embodiments of the disclosure further include a downhole assembly including a first component and a multilayered unit disposed on a surface of the first component, the multilayered unit including: a core comprising an energetic material and an activator; a support layer disposed on the core; and a protective layer disposed on the support layer, wherein the support layer and the protective layer each independently includes a polymeric material, a metallic material, or a combination comprising at least one of the foregoing, provided that the support layer is compositionally different from the protective layer. In any prior embodiment or combination of embodiments, the downhole assembly further includes a second component, and the multilayer unit is disposed between the first and second components. In any prior embodiment or combination of embodiments, the activator is a device that is effective to generate spark, electrical current, or a combination thereof to active the energetic material. In any prior embodiment or combination of embodiments, the first component, the second component, or both include Zn, Mg, Al, Mn, an alloy thereof, or a combination comprising at least one of the foregoing. In any prior embodiment or combination of embodiments, the multilayered unit has at least one stress concentration location. In any prior embodiment or combination of embodiments, the polymeric material comprises a polyethylene glycol, a polypropylene glycol, a polyglycolic acid, a polycaprolactone, a polydioxanone, a polyhydroxyalkanoate, a polyhydroxybutyrate, a copolymer thereof, or a combination including at least one of the foregoing.

Various embodiments of the disclosure further include a method of controllably removing a downhole article, the method including: disposing a downhole article of any one of the previous embodiments in a downhole environment; performing a downhole operation; activating the energetic material; and disintegrating the downhole article. In any prior embodiment or combination of embodiments, disintegrating the downhole article comprises breaking the downhole article into a plurality of discrete pieces; and the method further includes corroding the discrete pieces in a downhole fluid. In any prior embodiment or combination of embodiments, activating the energetic material includes triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Various embodiments of the disclosure further include a method of controllably removing a downhole assembly, the method including: disposing a downhole assembly of any one of the previous embodiments in a downhole environment; performing a downhole operation; activating the energetic material in the multilayered unit; and disintegrating the downhole assembly. In any prior embodiment or combination of embodiments, disintegrating the downhole assembly comprises breaking the downhole assembly into a plurality of discrete pieces; and the method further includes corroding the discrete pieces in a downhole fluid. In any prior embodiment or combination of embodiments, activating the energetic material comprises triggering the activator by a preset timer, a characteristic acoustic wave generated by a perforation from a following stage, a pressure signal from fracking fluid, an electrochemical signal interacting with a wellbore fluid, or a combination comprising at least one of the foregoing.

Set forth below are various additional embodiments of the disclosure.

Embodiment 1

A downhole assembly includes a downhole tool including a degradable-on-demand material, the degradable-on-demand material including: a matrix material; and, a unit in contact with the matrix material, the unit including: a core comprising an energetic material configured to generate energy upon activation to facilitate degradation of the downhole tool; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter; wherein, after the start signal is delivered from the control unit, the electrical circuit is closed and the igniter is initiated.

Embodiment 2

The downhole assembly as in any prior embodiment or combination of embodiments, wherein the electrical circuit further includes a timer, the control unit arranged to deliver the start signal to the timer, wherein, when a predetermined time period set in the timer has elapsed, the electrical circuit is closed.

Embodiment 3

The downhole assembly as in any prior embodiment or combination of embodiments, wherein in an open condition of the electrical circuit the igniter is inactive, and in a closed condition of the electrical circuit the igniter is activated, and the timer is operable to close the electrical circuit at an end of the predetermined time period.

Embodiment 4

The downhole assembly as in any prior embodiment or combination of embodiments, wherein the electrical circuit further includes a battery, the battery arranged to provide electric current to set off the igniter in the closed condition of the circuit.

Embodiment 5

The downhole assembly as in any prior embodiment or combination of embodiments, further comprising a perforation gun, wherein the sensor is configured to sense a shock wave that results from firing the perforation gun.

Embodiment 6

The downhole assembly as in any prior embodiment or combination of embodiments, wherein the sensor is configured to detect a pressure differential between an uphole area and a downhole area with respect to the downhole tool, and the event is related to a threshold value of the pressure differential.

Embodiment 7

The downhole assembly as in any prior embodiment or combination of embodiments, wherein the downhole tool includes a body having a piston chamber in fluidic communication with both the uphole area and the downhole area, and a piston configured to move in a downhole direction within the piston chamber when the threshold value of the pressure differential is reached.

Embodiment 8

The downhole assembly as in any prior embodiment or combination of embodiments, wherein the downhole tool further includes a vibratory element sensitive to a fluidic event, the sensor configured to detect vibrations of the vibratory element.

Embodiment 9

The downhole assembly as in any prior embodiment or combination of embodiments, wherein the vibratory element includes at least one of a reed and a caged ball configured to vibrate within fluid flow within a flowbore of the downhole assembly.

Embodiment 10

The downhole assembly as in any prior embodiment or combination of embodiments, wherein the sensor is configured to detect a mud pulse.

Embodiment 11

The downhole assembly as in any prior embodiment or combination of embodiments, wherein the sensor is configured to detect an electromagnetic wave.

Embodiment 12

The downhole assembly as in any prior embodiment or combination of embodiments, wherein the sensor is configured to detect at least one of a chemical element, an electrochemical element, and an electromagnetic tag.

Embodiment 13

The downhole assembly as in any prior embodiment or combination of embodiments, wherein the downhole tool is a frac plug configured to receive a frac ball.

Embodiment 14

The downhole assembly as in any prior embodiment or combination of embodiments, wherein a first component of the frac plug is formed of the degradable-on-demand material, and a second component of the frac plug is formed of the matrix material, the second component not including the energetic material, and the second component in contact with the first component.

Embodiment 15

The downhole assembly as in any prior embodiment or combination of embodiments, wherein the downhole tool is a flapper.

Embodiment 16

The downhole assembly as in any prior embodiment or combination of embodiments, wherein the unit further includes at least one layer disposed on the core.

Embodiment 17

The downhole assembly as in any prior embodiment or combination of embodiments, wherein the unit is a multi-layered unit and the at least one layer includes a support layer disposed on the core; and a protective layer disposed on the support layer, the support layer interposed between the core and the protective layer, wherein the support layer and the protective layer each independently comprises a polymeric material, a metallic material, or a combination comprising at least one of the foregoing, provided that the support layer is compositionally different from the protective layer.

Embodiment 18

The downhole assembly as in any prior embodiment or combination of embodiments, wherein the protective layer has a lower corrosion rate than the support layer.

Embodiment 19

The downhole assembly as in any prior embodiment or combination of embodiments, wherein the matrix material has a cellular nanomatrix, a plurality of dispersed particles dispersed in the cellular nanomatrix, and a solid-state bond layer extending through the cellular nanomatrix between the dispersed particles.

Embodiment 20

A method of controllably removing a downhole tool of a downhole assembly, the method including disposing the downhole assembly including the downhole tool in a downhole environment, the downhole tool including a degradable-on-demand material including a matrix material; and a unit in contact with the matrix material, the unit including a core comprising an energetic material configured to generate energy upon activation to facilitate degradation of the downhole tool; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter; sensing a downhole event or parameter with the sensor, the sensor sending sensed signals to the control unit; comparing the sensed signals to a target value, and when the target value is reached, sending the start signal to the electrical circuit; closing the electrical circuit after the start signal is sent; initiating the igniter when the electrical circuit is closed; activating the energetic material within the core using the igniter; and degrading the downhole tool.

Embodiment 21

The method as in any prior embodiment or combination of embodiments, wherein the electrical circuit further includes a timer, the control unit arranged to deliver the start signal to the timer, and initiating the igniter when a predetermined time period set in the timer has elapsed.

Embodiment 22

The method as in any prior embodiment or combination of embodiments, wherein the predetermined time period is zero, and the igniter is initiated substantially simultaneously when the start signal is delivered to the timer.

Embodiment 23

The method as in any prior embodiment or combination of embodiments, further compromising sending a time-changing signal to be sensed by the sensor, and changing the predetermined time period in response to the time-changing signal.

Embodiment 24

The method as in any prior embodiment or combination of embodiments, further comprising firing a perforating gun, wherein sensing the downhole event or parameter with the sensor includes sensing a shock wave that results from firing the perforating gun.

Embodiment 25

The method as in any prior embodiment or combination of embodiments, further comprising increasing fluid pressure uphole of the downhole tool, wherein sensing the downhole event or parameter with the sensor includes at least one of sensing fluid pressure uphole of the downhole tool, sensing a pressure differential between an uphole area and a downhole area with respect to the downhole tool, and sensing vibration of a vibratory element within the uphole area.

Embodiment 26

The method as in any prior embodiment or combination of embodiments, wherein sensing the downhole event or parameter with the sensor includes one or more of detecting frequencies of an electromagnetic wave and sensing a chemical or electrochemical element or electromagnetic tag.

Embodiment 27

The method as in any prior embodiment or combination of embodiments, wherein the target event or parameter includes a signal sent from an adjacent downhole tool.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity). Further, it should further be noted that the terms "first," "second," and the like herein do not denote any order, quantity, or importance, but rather are used to distinguish one element from another.

The teachings of the present disclosure apply to downhole assemblies and downhole tools that may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly comprising:

a downhole tool including a degradable-on-demand material, the degradable-on-demand material including:

a matrix material; and, a unit in contact with the matrix material, the unit including:

a core embedded in the matrix material and comprising an energetic material configured to generate energy upon activation to facilitate degradation of the matrix material; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter;

wherein, after the start signal is delivered from the control unit, the electrical circuit is closed and the igniter is initiated.

2. The downhole assembly of claim 1, wherein the electrical circuit further includes a timer, the control unit arranged to deliver the start signal to the timer, wherein, when a predetermined time period set in the timer has elapsed, the electrical circuit is closed.

3. The downhole assembly of claim 2, wherein in an open condition of the electrical circuit the igniter is inactive, and in a closed condition of the electrical circuit the igniter is activated, and the timer is operable to close the electrical circuit at an end of the predetermined time period.

4. The downhole assembly of claim 3, wherein the electrical circuit further includes a battery, the battery arranged to provide electric current to set off the igniter in the closed condition of the circuit.

5. The downhole assembly of claim 1, further comprising a perforation gun, wherein the sensor is configured to sense a shock wave that results from firing the perforation gun.

6. The downhole assembly of claim 1, wherein the sensor is configured to detect a pressure differential between an uphole area and a downhole area with respect to the downhole tool, and the event is related to the threshold value of the pressure differential.

7. The downhole assembly of claim 6, wherein the downhole tool includes a body having a piston chamber in fluidic communication with both the uphole area and the downhole area, and a piston configured to move in a downhole direction within the piston chamber when the threshold value of the pressure differential is reached.

8. The downhole assembly of claim 1, wherein the downhole tool further includes a vibratory element sensitive to a fluidic event, the sensor configured to detect vibrations of the vibratory element.

9. The downhole assembly of claim 1, wherein the sensor is configured to detect a mud pulse.

10. The downhole assembly of claim 1, wherein the sensor is configured to detect an electromagnetic wave.

11. The downhole assembly of claim 1, wherein the sensor is configured to detect at least one of a chemical element, an electrochemical element, and an electromagnetic tag.

12. The downhole assembly of claim 1, wherein the downhole tool is a frac plug configured to receive a frac ball.

13. The downhole assembly of claim 12, wherein a first component of the frac plug is formed of the degradable-on-demand material, and a second component of the frac plug is formed of the matrix material, the second component not including the energetic material, and the second component in contact with the first component.

14. The downhole assembly of claim 1, wherein the downhole tool is a flapper.

15. The downhole assembly of claim 1, wherein the unit further includes at least one layer disposed on the core.

16. The downhole assembly of claim 15, wherein the unit is a multi-layered unit and the at least one layer includes a support layer disposed on the core; and a protective layer disposed on the support layer, the support layer interposed between the core and the protective layer, wherein the support layer and the protective layer each independently comprises a polymeric material, a metallic material, or a combination comprising at least one of the foregoing, provided that the support layer includes a different material from the protective layer.

17. The downhole assembly of claim 16, wherein the protective layer has a lower corrosion rate than the support layer.

18. The downhole assembly of claim 16, wherein the matrix material has a cellular nanomatrix, a plurality of dispersed particles dispersed in the cellular nanomatrix, and a solid-state bond layer extending through the cellular nanomatrix between the dispersed particles.

19. A method of controllably removing a downhole tool of a downhole assembly, the method comprising:

disposing the downhole assembly including the downhole tool in a downhole environment, the downhole tool including a degradable-on-demand material including a matrix material; and a unit in contact with the matrix material, the unit including a core embedded within the matrix material and comprising an energetic material configured to generate energy upon activation to facilitate degradation of the matrix material; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter;

sensing a downhole event or parameter with the sensor, the sensor sending the sensed signals to the control unit;

comparing the sensed signals to a target value, and when the target value is reached, sending the start signal to the electrical circuit;

closing the electrical circuit after the start signal is sent;

initiating the igniter when the electrical circuit is closed;

activating the energetic material within the core using the igniter; and degrading the downhole tool.

20. The method of claim 19, wherein the electrical circuit further includes a timer, the control unit arranged to deliver the start signal to the timer, and initiating the igniter when a predetermined time period set in the timer has elapsed.

21. The method of claim 20, wherein the predetermined time period is zero, and the igniter is initiated substantially simultaneously when the start signal is delivered to the timer.

22. The method of claim 20, further comprising sending a time-changing signal to be sensed by the sensor, and changing the predetermined time period in response to the time-changing signal.

23. The method of claim 19, further comprising firing a perforating gun, wherein sensing the downhole event or parameter with the sensor includes sensing a shock wave that results from firing the perforating gun.

24. The method of claim 19, further comprising increasing fluid pressure uphole of the downhole tool, wherein sensing the downhole event or parameter with the sensor includes at least one of sensing fluid pressure uphole of the downhole tool, sensing a pressure differential between an uphole area and a downhole area with respect to the downhole tool, and sensing vibration of a vibratory element within the uphole area.

25. The method of claim 19, wherein sensing the downhole event or parameter with the sensor includes one or more of detecting frequencies of an electromagnetic wave and sensing a chemical or electrochemical element or electromagnetic tag.

26. The method of claim 19, wherein the target event or parameter includes a signal sent from an adjacent downhole tool.

27. A downhole assembly comprising:

a downhole tool including a degradable-on-demand material, the degradable-on-demand material including:

a matrix material; and, a unit in contact with the matrix material, the unit including:

a core comprising an energetic material configured to generate energy upon activation to facilitate degradation of the downhole tool; and, an activator disposed in contact with the core, the activator having a triggering system including an electrical circuit, an igniter in the electrical circuit arranged to ignite the energetic material, a sensor configured to sense a target event or parameter within the borehole, and a control unit arranged to receive sensed signals from the sensor, the control unit configured to deliver a start signal to the electrical circuit in response to the sensed signals indicating an occurrence of the target event or parameter; and a vibratory element sensitive to a fluidic event, the vibratory element includes at least one of a reed and a caged ball configured to vibrate within fluid flow within a flowbore of the downhole assembly, the sensor configured to detect vibrations of the vibratory element;

wherein, after the start signal is delivered from the control unit, the electrical circuit is closed and the igniter is initiated.

* * * * *